US010607758B2

(12) United States Patent
Eckhardt et al.

(10) Patent No.: US 10,607,758 B2
(45) Date of Patent: Mar. 31, 2020

(54) ELECTROMAGNETIC ACTUATOR AS WELL AS ACTUATING SYSTEM

(71) Applicant: ETO Magnetic GmbH, Stockach (DE)

(72) Inventors: Harald Eckhardt, Uhldingen-Mühlhofen (DE); Stefan Bender, Engen (DE)

(73) Assignee: ETO Magnetic GmbH, Stockach (DE)

( * ) Notice: Subject to any disclaimer, the term of this patent is extended or adjusted under 35 U.S.C. 154(b) by 96 days.

(21) Appl. No.: 16/061,838

(22) PCT Filed: Nov. 23, 2016

(86) PCT No.: PCT/EP2016/078514
§ 371 (c)(1),
(2) Date: Jun. 13, 2018

(87) PCT Pub. No.: WO2017/102271
PCT Pub. Date: Jun. 22, 2017

(65) Prior Publication Data

US 2018/0366249 A1 Dec. 20, 2018

(30) Foreign Application Priority Data

Dec. 14, 2015 (DE) ..... 10 2015 121 707

(51) Int. Cl.
*H01F 7/16* (2006.01)
*H01F 7/08* (2006.01)
*H01F 7/13* (2006.01)

(52) U.S. Cl.
CPC ..... *H01F 7/1607* (2013.01); *H01F 7/081* (2013.01); *H01F 7/13* (2013.01); *H01F 2007/085* (2013.01); *H01F 2007/163* (2013.01)

(58) Field of Classification Search
CPC ..... H01F 2007/085; H01F 2007/163
See application file for complete search history.

(56) References Cited

U.S. PATENT DOCUMENTS 4,231,525 A 11/1980 Palma
5,504,468 A 4/1996 Hattori
(Continued)

FOREIGN PATENT DOCUMENTS

DE 19882903 T1 11/2000
DE 20218782 U1 4/2003
(Continued)

OTHER PUBLICATIONS

International search report for patent application No. PCT/EP2016/078514 dated Feb. 10, 2017.

*Primary Examiner* — Ramon M Barrera
(74) *Attorney, Agent, or Firm* — Bachman & LaPointe, PC

(57) ABSTRACT

An electromagnetic positioning device (1), having a stationary spool unit (9), having a moveably guided anchor (2), which forms a positioning section (14) and which can be axially displaced along a displacement axis (V) in response to supplying the spool unit (9) with current, as well as having a one-part cup-shaped yoke-core element (3), which receives the anchor (2) and which includes a core section (5) as well as a yoke section (6) and which has a yoke-core bottom (4) extending perpendicular to the displacement axis (V) and a yoke-core sheath extending perpendicular to the yoke-core bottom (4) along the displacement axis (V), a longitudinally cut transition area (8) reduced in thickness and arranged between the core section (5) and the yoke section (6) being realized in the yoke-core sheath. It is intended that a guide pin (17) for the anchor (2) is fixed, preferably pressed in, in a, preferably centric, guide pin recess (18) in the yoke-core bottom (4) and protrudes axially into a, preferably centric, guide opening (13) of the anchor (2) and can be displaced relative to the anchor (2) during its displacement movement.

18 Claims, 3 Drawing Sheets

(56) References Cited

U.S. PATENT DOCUMENTS

| | | | |
|---|---|---|---|
| 7,113,064 | B2 | 9/2006 | Loubat et al. |
| 2013/0032742 | A1 | 2/2013 | Scherer et al. |

FOREIGN PATENT DOCUMENTS

| | | | |
|---|---|---|---|
| DE | 102006015233 | A1 | 10/2007 |
| EP | 0373383 | A1 | 6/1990 |
| EP | 2528070 | A2 | 11/2012 |
| GB | 1214299 | A | 12/1970 |
| JP | 614458 | A | 1/1986 |
| JP | 0232748 | A | 2/1990 |
| JP | 02209705 | A | 8/1990 |
| JP | 0711887 | U | 2/1995 |
| JP | 07307218 | A | 11/1995 |
| JP | 2001522140 | A | 11/2001 |
| JP | 2005045055 | A | 2/2005 |
| JP | 2005090547 | A | 4/2005 |
| JP | 2012216680 | A | 11/2012 |
| JP | 2013038158 | A | 2/2013 |
| WO | 9923674 | A1 | 5/1999 |

ELECTROMAGNETIC ACTUATOR AS WELL AS ACTUATING SYSTEM

BACKGROUND OF THE INVENTION

The invention relates to an electromagnetic positioning device, in particular a pull device, having a stationary spool unit, having a moveably guided anchor, in particular a pull anchor, which forms a positioning section and which can be axially displaced along a displacement axis in response to supplying the spool unit with current, as well as having a one-part cup-shaped yoke-core element, which receives the anchor and which comprises a core section as well as a yoke section and which has a yoke-core bottom extending perpendicular to the displacement axis and a yoke-core sheath extending perpendicular to the yoke-core bottom along the displacement axis, a longitudinally cut transition area reduced in thickness and arranged between the core section and the yoke section being realized in the yoke-core sheath.

Such positioning devices, which are described in DE 10 2006 015 233 B4 by the same applicant, for example, are optimized and adapted to the respective positioning task in regard of the geometry for casings, cores, yokes and anchors. Owing to the provision of a one-part yoke-core element, the positioning device known from the aforementioned document is suitable for being mass produced in an automated fashion in contrast to the positioning devices described in DE 198 82 903 T1 or DE 202 18 782 U1, in which separate core and yoke elements are intended.

In spite of the generally good suitability for the mass production of the generic positioning device comprising a one-part yoke-core element, improvements regarding the mass production are continuously sought for, in particular for electromagnetic positioning devices which are not designed as pressure positioning devices contrary to the positioning device described in DE 10 2006 015 233 B4 but are rather designed as a pull device comprising a pull anchor.

SUMMARY OF THE INVENTION

Starting from the aforementioned state of the art, the object of the invention is therefore to indicate an electromagnetic positioning device suitable for mass production which is characterized by a good suitability for automatable production while simultaneously having a minimized assembly space. In this context, the electromagnetic positioning device is to be realized as a pull device in a preferred embodiment, in which the anchor forming a pull anchor is displaced towards the yoke-core bottom upon supplying the spool unit with current. Even more preferably, in the scope of a positioning system, the electromagnetic positioning device is to also be used for applications in which a torque is applied to the anchor, in particular via the positioning partner, and acts to rotate the anchor around its displacement axis, in particular at a high rotation.

In regard of the electromagnetic positioning device, the object is attained by the features disclosed herein, i.e. in a generic positioning device by a guide pin for the anchor being fixed, in particular by being pressed in, in a, preferably centric, guide pin recess in the yoke-core bottom, said guide pin protruding axially into a, preferably centric, guide opening of the anchor and being displaceable relative to the anchor during its axial displacement movement.

When realizing the positioning device according to the invention as a pull device, the anchor can also be moved away from the yoke-core bottom in different manners, e.g. by a polarity reversal of the current supply of the spool unit and/or by a spring force tension of an optionally provided return spring and/or by a tensile strength exerted by the positioning partner.

Further advantageous embodiments of the invention are described in the dependent claims.

In an advantageous manner according to the invention, a plurality of functions of the positioning device is realized in a multifunctional assembly whose rotation point and pivotal point is the one-part yoke-core element. Hence, it is intended according to the invention that besides a magnetic flow conducting function and a flow coupling function of the core section for coupling the magnetic flow into the anchor, the yoke-core element also has a carrier function or rather a holding function for holding a guide pin for the anchor by the yoke-core bottom, which extends perpendicular to the displacement axis and which preferably simultaneously forms an abutment for delimiting the axial displacement movement of the anchor, comprising a, preferably centric, guide pin recess in which a guide pin is fixed, preferably by being pressed in, which protrudes into a corresponding, preferably centric guide opening of the anchor upon its axial displacement movement, in particular via the entire maximal displacement distance, and which extends parallel to the longitudinal extension of the sleeve-shaped yoke section.

As an additional function of the one-part yoke-core element, it is intended in an embodiment of the invention for the yoke-core element to provide a carrier surface or rather holding surface for a sliding bearing, in particular on its inner circumference, more preferably on the inner circumference of the yoke section arranged axially adjacent to the core section, said sliding bearing being fixed by being pressed in and/or by being glued and/or by being soldered and/or in a different manner to the yoke-core element and said sliding bearing guiding the anchor on its outer circumference during its axial displacement movement.

In summary, it is intended according to the embodiment that essential guide functions for the anchor, preferably realized or controlled as a pull anchor, are focused on the yoke-core element, which is a direct carrier for a guide pin for guiding the anchor on its inner circumference as well as a carrier for a sliding bearing for guiding the anchor on its outer circumference.

Owing to the use of the one-part yoke-core element according to the invention, a magnetic short circuit occurs in the transition area between the core and the yoke and allows magnetic satiation in this transition area preferably even at low spool currents, whereby negative impacts on the efficiency and effectivity on the one-part design of the yoke and the core are kept in check. This effect can be further attenuated by the electromagnetic positioning device acting like a proportional magnet working against a resilience according to a preferred embodiment of the invention so that losses ascribed to the short circuit are outside of the operational characteristics in the power/lift diagram of the device and therefore do not have any significant effect.

Overall, it is particularly advantageous if the core section and/or the yoke section are/is longitudinally conically tapered in their/its thickness towards the transition area and are/is configured such that a load-displacement diagram of the positioning device shows a linear progression via the lift when the current is consistent in the spool.

It has proven to be particularly advantageous if the guide pin recess is designed in the yoke-core bottom as an axial through opening, in particular a through bore, which even more preferably is sealed at the end, i.e. on the axial side facing away from the anchor, by the guide pin. As will be described further on, a preferably elastomeric abutment attenuation element, which can be displaced in conjunction with the anchor, can be supported in the axial direction, in particular at the bottom, in this sealed opening or, in an alternative embodiment, at the bottom of a blind bore opening, said anchor being supported in conjunction with said abutment attenuation element in an abutment position towards the core section, in particular on the front at the guide pin.

It is just as advantageous if the guide opening in the anchor is also designed as a through opening, on the one hand for a simplified production and on the other hand, in manner according to the embodiment, for fixing a push rod or rather a push rod section of the anchor to a, preferably sleeve-shaped, guide section comprising a guide opening according to the invention and guided on the sliding bearing (sliding bearing connection) on the outer circumference.

By combining the aforementioned at least two bearing functions in the yoke-core element and the preferably direct or indirect terminal abutment function of the yoke-core bottom, sophisticated geometries, which would be necessary from a production perspective when realizing the functions independently of each other, can be omitted and moreover less assembly space is required.

It is particularly convenient for the invention if the yoke-core element takes over another function besides the aforementioned two bearing functions and serves as a holder for an anti-twist pin, which is arranged adjacent to a longitudinal center axis of the anchor and which protrudes into an anti-twist pin recess parallel to the guide pin. In the embodiment of the invention, this anti-twist pin is fixed in the yoke-core bottom (adjacent to the guide pin, preferably at a distance thereto), in particular in an anti-twist pin recess, it being particularly preferred to press the anti-twist pin into said anti-twist pin recess while additionally or alternatively also being able to be welded or glued. It is particularly convenient for the invention to design the anti-twist pin recess as a blind bore, which is sealed at the end on the side of the anti-twist pin facing away from the anchor. Preferably, the anti-twist pin opening, in which the anti-twist pin engages during the displacement movement of the anchor, in particular via its entire axial displacement path, is also designed as a through bore in the anchor from a production standpoint. Providing an anti-twist pin according to the invention enables using the electromagnetic positioning device in the scope of positioning systems, in which a torque is applied to the anchor and acts to rotate the anchor around its displacement axis which preferably coincides with its longitudinal center axis. In particular when a high rotation speed is involved, such as it occurs when using the electromagnetic positioning device in conjunction with combustion engines and/or electric motors in motor vehicles, the omission of an anti-twist device would lead to large stresses and to a large wear of the positioning device. The design of the anti-twist device as an anti-twist pin and the anchoring of the anti-twist pin in the one-part yoke-core element, more specifically in the yoke-core bottom, lead to a handy, easily produced embodiment suitable for mass production.

As previously mentioned, it is particularly convenient if the yoke-core bottom forms an axial abutment (terminal abutment) for the anchor. Alternatively thereto, the yoke-core section can form a support surface for an abutment attenuation element, which can be optionally arranged in the interior, which is delimited by the yoke-core element, between the front side of the anchor and the yoke-core bottom.

In an alternative embodiment, the yoke-core bottom does not form an axial abutment (terminal abutment) for the anchor; in this alternative embodiment, however, the function of the axial abutment is assumed by the guide pin, which is correspondingly dimensioned long enough in the axial direction that the anchor is supported on the guide pin directly or indirectly via a, preferably elastomeric, abutment attenuation element when in a terminal abutment position. This abutment attenuation element can be displaced back and forth preferably in conjunction with the anchor and preferably fixed to the anchor for this purpose. This can be realized by, for example, the abutment attenuation element being pressed in the guide opening in order to receive the guide pin. For this purpose, the guide opening can be realized as a blind bore, it then being advantageous if the abutment attenuation element is axially supported on the blind bore bottom. In an alternative embodiment, in which the guide opening is not realized as a blind bore but as a through opening, which is sealed at the end side by a push rod section, in a multipart anchor embodiment to be described further on, the abutment attenuation element preferably is supported axially on a front side of the push rod section received in the through opening. It is generally possible to additionally or alternatively support the abutment attenuation element axially on a circular shoulder or a similar support surface of the guide opening independently of realizing the guide opening as a through opening, in particular sealed by a push rod section, or as a blind bore opening sealed at the end side.

Additionally or alternatively to an abutment attenuation element arranged in the guide opening as described above, at least one abutment attenuation element can be provided on the front side of the anchor facing away from the guide pin recess in the yoke-core bottom, such an abutment attenuation element preferably being fixed, in particular pressed in a front-side opening, on the anchor so that the anchor can be supported in a terminal abutment position on the axial side facing from the yoke-core bottom, in particular on the side of the casing, via this abutment attenuation element. The provision of abutment attenuation elements on both axial sides of the anchor leads to an optimized noise reduction.

It is also possible, in particular instead of providing an abutment attenuation element in the guide opening, to arrange an abutment attenuation element adjacent to the guide opening, in particular fix it to the anchor, in order to support the anchor in a terminal abutment position on the side of the yoke-core bottom via the abutment attenuation element on the yoke-core bottom. A loose arrangement of an abutment attenuation element between the anchor and an immobile component of the positioning device is also possible. It is also possible to realize an abutment attenuation element so as to be fixed, in particular pressed in a component opening, in particular in the yoke-core bottom, not on the anchor but on an immobile component.

An embodiment is particularly preferred in which the one-part yoke-core element has an additional function, namely by serving as a holder or axial securing for a washer element, which is fixed in an inner circumferential groove of the yoke-core element in an embodiment of the invention and which is penetrated by the anchor.

According to a first alternative, the washer element itself can directly serve as a (direct) terminal abutment element axially opposite the yoke-core bottom or alternatively as a carrier (direct terminal abutment element) for an optional attenuation element for attenuating the axial abutment. It is particularly preferable if the washer element in the aforementioned inner circumferential groove of the yoke-core element is fixed, i.e. axially secured, by being axially tensioned, which is realized by the washer element being able to be resiliently tensioned in the radial direction in order to be inserted and then being able to be relaxed outward in the radial direction in order to radially snap into place from the inside out in the inner circumferential groove of the yoke-core element. In an embodiment of the invention, this function can be realized in particular by the washer element being realized as a spring lock washer, namely from a material, particularly preferably bronze, which does not conduct or only badly conducts the magnetic flow. According to a first alternative, the washer element can be received in a relaxed manner in the circular groove or alternatively under a locking-spring force acting in the radial direction when in the fixed position.

In particular in a preferred embodiment of the positioning device, in which an axial anti-twist pin is provided besides the axial guide pin, it is convenient if the anchor carries a ball bearing, preferably realized as a rolling bearing, in its positioning section, preferably realized in the shape of a push rod (a component of the positioning partner being rolled off on the rolling bearing relative to the anchor arranged in a torque-proof manner, preferably having a high rotation speed, e.g. over 1,000 rpm).

As already indicated above, it is possible and preferable to design the anchor as having multiple parts besides a generally conceivable one-part design of the anchor, said multipart anchor then preferably comprising a, preferably sleeve-shaped, guide section, which preferably comprises a guide opening realized as a through opening and on which a one-part or multipart push rod section is fixed, which comprises or forms the positioning section and which preferably has a smaller diameter than the guide section, it being particularly convenient if sections of the push rod section are received in the guide opening in a fixing manner, in particular by being pressed in.

It is particularly preferable if the yoke-core element and the spool unit, which radially surrounds the yoke-core element at least in sections from the outside, are arranged in a shared flow-conductive casing, which serves for the flow return. Preferably, the casing is connected to the yoke section of the yoke-core element via a yoke washer on the side axially opposite the core section, said yoke washer preferably securing axially the yoke-core element in the casing.

How the anchor is mounted can be further optimized according to a preferred embodiment of the invention, in which the anchor is supported on the guide pin via a sliding bearing, said (internal) sliding bearing preferably being arranged, in particular pressed in, in the guide opening of the anchor for this purpose. Preferably, the internal sliding bearing is axially spaced from the optional though preferably provided sliding bearing (external sliding bearing) in order to guide the anchor on its outer circumference, said external sliding bearing, as mentioned above, preferably being fixed, in particular pressed in, in the yoke-core element, in particular on the inner circumference of the yoke-core element.

The invention also leads to a positioning system comprising an electromagnetic positioning device realized according to the invention as well as a positioning partner, which is preferably realized so as to introduce a torque around the displacement axis in the anchor, in particular via a rolling bearing fixed to the anchor.

Further advantages, features and details of the invention can be derived from the following description of preferred exemplary embodiments as well as from the drawings.

BRIEF DESCRIPTION OF THE DRAWINGS

In the following.

In the figures, the same elements and elements having the same function are denoted with the same reference number.

DETAILED DESCRIPTION

Figure 1:
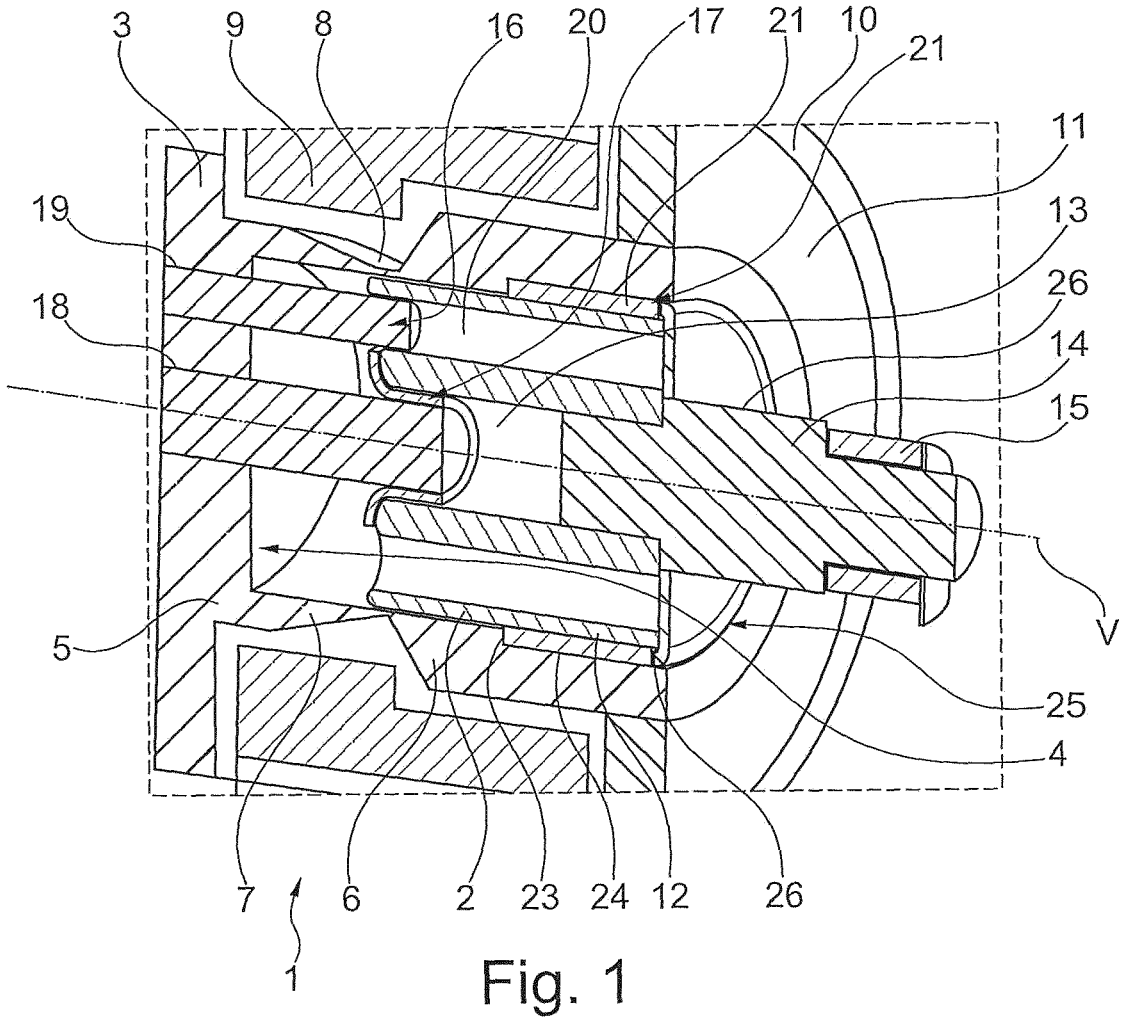
FIG. 1 illustrates a perspective longitudinal cut of a preferred exemplary embodiment of an electromagnetic positioning device realized according to the invention.

In FIG. 1, an electromagnetic positioning device 1 realized according to the invention is illustrated; said electromagnetic positioning device 1 comprises a two-part anchor 2, which is arranged so as to be axially displaceable along a displacement axis V within a one-part yoke-core element 3, which is preferably designed in general as a rotation-symmetric rotational part.

The yoke-core element 3 comprises a core section 5, which comprises a yoke-core bottom 4, for coupling the magnetic flow in the anchor as well as an essentially sleeve-shaped yoke section 6, which extends parallel to the displacement axis V and which radially surrounds the anchor 2 from the outside on the outer circumference.

Besides the yoke-core bottom 4, the core section 5 comprises a sleeve-shaped cone section 7, which forms an axial section of a longitudinally cut transition area 8 reduced in thickness and arranged between the core section 5 and the yoke section 6. It can be seen that a spool unit 9 extends radially outward around the transition area 8.

In the specific exemplary embodiment, the positioning device 1 is designed as a pull device and the anchor 2 has the function of a pull anchor so that when the spool unit 9 is supplied with current, the anchor 2 is displaced along the displacement axis V towards the yoke-core bottom. The yoke-core bottom forms a direct axial terminal abutment for delimiting the axial displacement axis in this specific exemplary embodiment.

Preferably, a return spring, which can be supported on the anchor 2 on the front side and which is not illustrated, is provided for displacing the anchor 2 in the opposite axial direction (positioning direction).

The yoke-core element 3 is received in a flow conductive, preferably cup-shaped casing 10 in conjunction with the spool unit 9 and is axially secured therein via a yoke washer 11, which is closely fit to the yoke section 6 from radially outward while simultaneously axially securing said yoke section 6 and carrying it between the yoke section and the casing 10 for a magnetic flow conduction.

As previously mentioned the anchor 2 is designed in two parts and comprises a sleeve-shaped guide section 12, which is larger in diameter and which comprises a guide opening 13 realized as a through opening, in which a positioning section 14, which is realized as a push rod section of the anchor 2, is pressed in on an end side. The positioning section 14 carries an only partially illustrated rolling bearing 15 in its axial end section, a positioning partner being able to roll off on said rolling bearing 15 in the circumferential direction around the displacement axis V. In order to prevent a drag torque caused thereby from rotating the anchor 2 around the displacement axis V in the circumferential direction, an anti-twist pin 16 is provided which will be described further on.

On the side facing away from the positioning section 14, an axial guide pin 17 protrudes in the guide opening 13 and is fixed in a centric guide pin recess 18 in the yoke-core bottom 4, said guide pin opening 18 being realized as a through opening, and is centrically penetrated by the displacement axis V, just like the centric guide opening 13. The guide pin 17 is made of a magnetic nonconductive material and serves for guiding the anchor 2 on the inner circumference of the guide opening 13.

The aforementioned anti-twist pin 16 is arranged having a radial distance to the guide pin 17 and is held in an eccentrically arranged anti-twist pin recess 19 in the yoke-core bottom 4 by being pressed in, said anti-twist pin recess 19 also being realized as a through opening. The anti-twist pin 16 engages in an anti-twist pin opening 20, which is also realized as a through opening and which extends parallel to the centric guide opening 13, in the guide section of the anchor 2 and thus prevents the anchor 2 from rotating in the circumferential direction.

Parallel to the anti-twist pin opening, a compensation opening (through opening), which has the same size in this example, is provided in the guide section 12 of the anchor 2 in order to compensate pressure between the cylinder spaces within the yoke-core element 3 delimited by the front sides of the guide section 12 upon a displacement movement.

In order to guide the anchor 2, more specifically the guide section 12 on its outer circumference, a sliding bearing 21 realized as a sliding bearing connection is provided which is arranged on the inner circumference of the yoke section 6 of the yoke-core element 3. The sliding bearing 21 is axially secured by a step 23, which is realized on the inner circumference of the yoke-core element 3 and which abuts against a circumferential support surface 24 for the sliding bearing 21.

The guide section 12 of the anchor 2 is axially secured in the yoke-core element 3 by a magnetically nonconductive washer element 25 which radially outward engages resiliently in an inner circumferential groove 26 in the yoke section 6. A centric opening 26 in the washer element 25 is penetrated by the push-rod-shaped positioning section 14 of the anchor 2; the guide section 12 of the anchor 2 can axially abut against the washer element 25, which functions according to the principle of a spring lock washer, with its front side facing away from the yoke-core body 4.

The yoke-core element 3 of the illustrated positioning device 1 represents the basis of a multifunctional assembly, which carries the guide pin 17 fixed in the yoke-core bottom 4 and the anti-twist pin 16 also fixed in the yoke-core bottom 4 as well as the sliding bearing 21 for guiding the anchor 2 on its outer circumference. Furthermore, the yoke-core element 3 serves for holding the washer in a clamping manner, said washer being penetrated by the anchor 2 and delimiting the axial movement of the anchor 2 on the axial side facing away from the yoke-core bottom 4.

The very compact design according to the invention enables using the available assembly space for increasing the magnetic performance.

In the following, alternative embodiments also realized according to the invention are described, with particular emphasis on the differences to the embodiments according to FIG. 1. In order to avoid repetitions, the description of figures above is referred to regarding any similaripulls.

Figure 2:
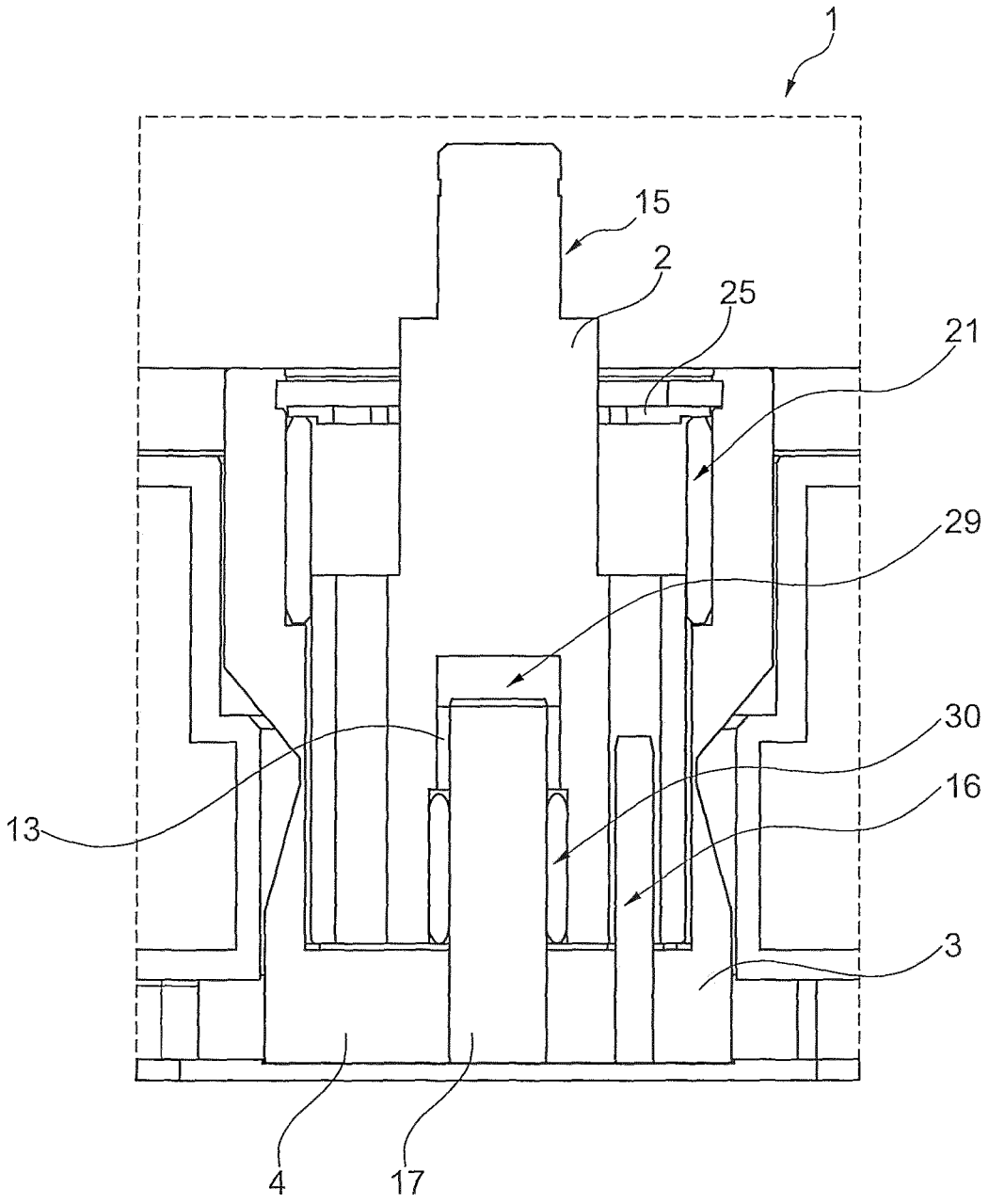
FIG. 2 illustrates an alternative preferred embodiment of a positioning device according to the invention having an axial abutment attenuation element fixed in a guide opening as well as having an internal sliding bearing.

The anchor 2 of the electromagnetic positioning device 1 according to FIG. 2 can be realized as having one part, for example. In this instance, the guide opening 13 is designed as a blind bore for receiving the guide pin 17, preferably as illustrated. In this blind bore, an abutment attenuation element 29 is pressed in, via which the anchor 2 can be supported on the guide pin 17 on the front side in a terminal abutment position, which is lower according to the drawing plane. In contrast to the exemplary embodiment described above, the yoke-core element 4 does not form a terminal abutment in the illustrated embodiment. This function of the terminal abutment is directly adopted by the guide pin 17.

Another difference of the exemplary embodiment according to FIG. 2 is in the provision of an internal sliding bearing 30 (which can also be provided in the embodiment according to FIG. 1) additionally to the (external) sliding bearing 21 in this instance. The internal sliding bearing 30 is pressed in the guide opening 13 realized as a blind bore opening in a merely exemplary manner and thus moves axially in conjunction with the anchor 2 and guides the anchor 2 on the outer circumference of the centrically arranged guide pin 17 during this axial movement.

Figure 3:
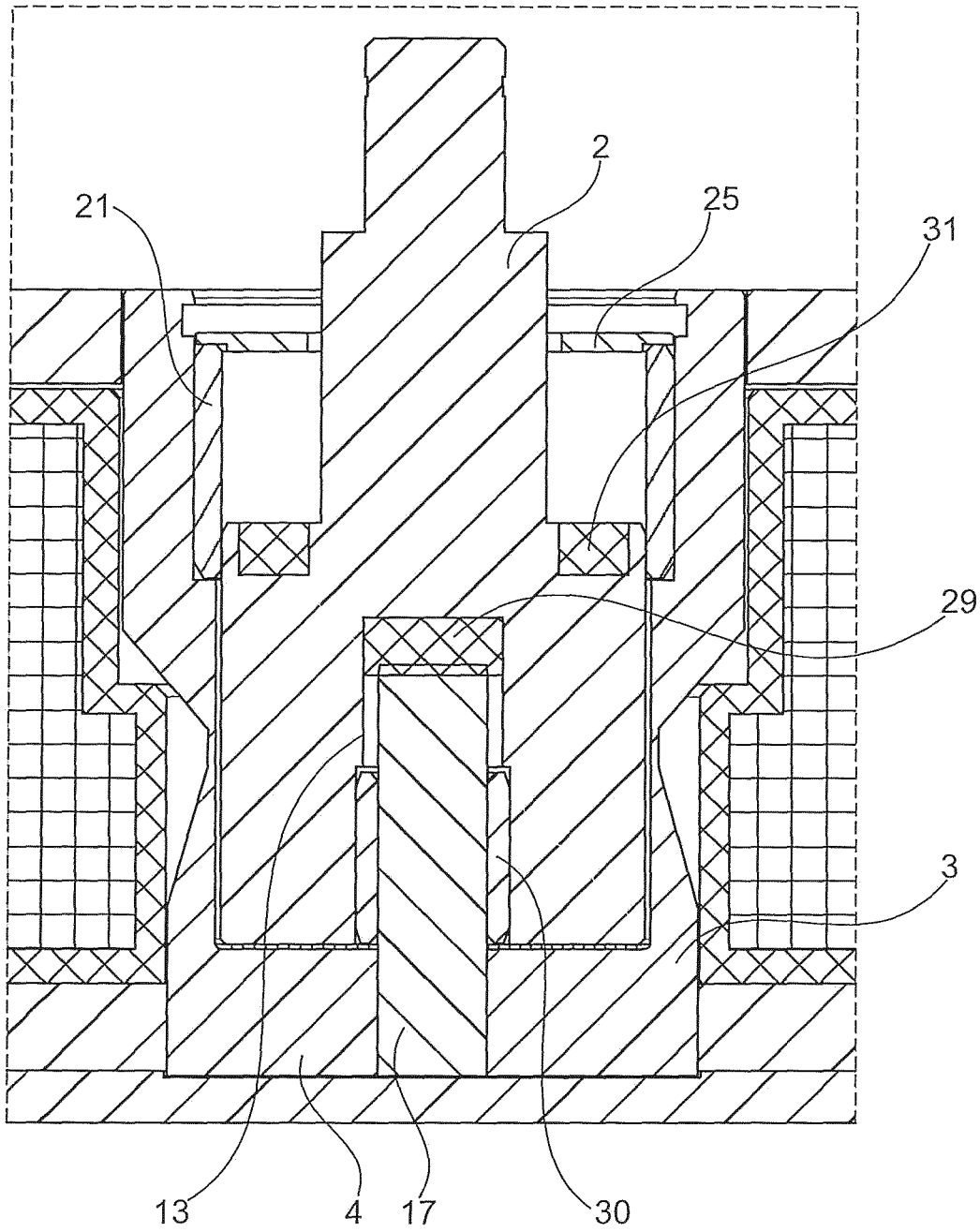
FIG. 3 illustrates another alternative preferred embodiment having abutment attenuation elements provided on both axial sides of the anchor.

In the alternative embodiment according to FIG. 3, another abutment attenuation element 31, designed circular in this instance for example, is arranged on the axial side of the anchor 2 facing away from the guide opening 13 or, in other words, on an axial side of the anchor 2 facing away from the yoke-core bottom 4 in addition to the abutment attenuation element 29 arranged in the guide opening 13 also realized as a blind bore opening in an exemplary manner. The abutment attenuation element 31 is pressed in an opening, which is shaped like a circular groove for example, in a circular shoulder of the anchor 2 and serves for attenuating the anchor abutment in its abutment position, which is higher according to the drawing, said anchor 2 being axially supported on the washer element 25 via the circular-groove-shaped abutment attenuation element 31 in said abutment position. In this embodiment according to FIG. 3, the internal sliding bearing 30 is also provided in order to guide the anchor on the outer circumference of the guide pin 17.

It is explicitly noted that the features and functions added in FIGS. 2 and 3 can be combined individually and in any other combination with features of the respective other exemplary embodiments.

Hence, the embodiment according to FIG. 3 can also be carried out having an anti-twist pin, for example, in order to prevent a rotation of the anchor 2, in particular should a rolling bearing be arranged on the anchor.

LIST OF REFERENCES

1 electromagnetic positioning device
2 anchor
3 yoke-core element
4 yoke core bottom
5 core section
6 yoke section
7 cone section
8 transition area
9 spool unit
10 casing
11 yoke washer
12 guide section
13 guide opening
14 positioning section
15 rolling bearing
16 anti-twist pin
17 guide pin
18 guide pin recess
19 anti-twist pin recess

20 anti-twist pin opening
21 sliding bearing
23 step
24 support surface
25 washer element
26 inner circumferential groove
27 opening
28 compensation bore
29 abutment attenuation element
30 sliding bearing
31 circular abutment attenuation element
V displacement axis

The invention claimed is:

1. An electromagnetic positioning device (1), having a stationary spool unit (9), having a moveably guided anchor (2), which forms a positioning section (14) and which can be axially displaced along a displacement axis (V) in response to supplying the spool unit (9) with current, as well as having a one-part cup-shaped yoke-core element (3), which receives the anchor (2) and which comprises a core section (5) as well as a yoke section (6) and which has a yoke-core bottom (4) extending perpendicular to the displacement axis (V) and a yoke-core sheath extending perpendicular to the yoke-core bottom (4) along the displacement axis (V), a longitudinally cut transition area (8) reduced in thickness and arranged between the core section (5) and the yoke section (6) being realized in the yoke-core sheath,
wherein
a guide pin (17) for the anchor (2) is fixed in a guide pin recess (18) in the yoke-core bottom (4) and protrudes axially into a guide opening (13) of the anchor (2) and can be displaced relative to the anchor (2) during its displacement movement.

2. The electromagnetic positioning device (1) according to claim 1, wherein on the yoke-core element (3), a sliding bearing (21) is fixed for guiding the anchor (2) on its outer circumference.

3. The electromagnetic positioning device according to claim 1, wherein an anti-twist pin (16) extending parallel to the guide pin (17) is arranged adjacent to the guide pin (17) and is fixed in an anti-twist pin recess (19) in the yoke-core bottom (4).

4. The electromagnetic positioning device according to claim 1, wherein the yoke-core bottom (4) forms a direct or indirect axial terminal abutment for the anchor (2) or a support surface for an abutment attenuation element.

5. The electromagnetic positioning device according to claim 1, wherein the anchor (2) is axially arranged between the yoke-core bottom (4) and a washer element (25) penetrated by the anchor (2), said washer element (25) being fixed in an inner circumferential groove (26) of the yoke-core element (3).

6. The electromagnetic positioning device according to claim 5, wherein the washer element (25) is realized as a spring lock washer.

7. The electromagnetic positioning device (1) according to claim 1, wherein on the anchor (2), an abutment attenuation element is fixed via which the anchor (2) is supported in at least one terminal abutment position on an immobile component.

8. The electromagnetic positioning device according to claim 1, wherein in its positioning section (14), the anchor (2) carries a rolling bearing (15) realized as a ball bearing.

9. The electromagnetic positioning device according to claim 1, wherein the anchor (2) is made of multiple parts and comprises a guide section (12), which comprises the guide opening (13) and on which a push rod section, which comprises the positioning section (14) and which is made of one or multiple parts and has a smaller diameter than the guide section (12), is fixed.

10. The electromagnetic positioning device according to claim 1, wherein the spool unit (9) is supplied or can be supplied with current via a control in such a manner that the anchor (2) moves axially along the displacement axis towards the yoke-core bottom (4) upon supply with current.

11. The electromagnetic positioning device according to claim 1, wherein the yoke-core element (3) and the spool unit (9) are arranged in a current-conductive casing (10).

12. A positioning system, comprising an electromagnetic positioning device (1) according to claim 1, as well as a positioning partner, which is realized in the anchor (2) so as to introduce a torque around the displacement axis (V) via a rolling bearing (15) fixed on the anchor (2).

13. The electromagnetic positioning device according to claim 1, wherein an internal sliding bearing is arranged on the anchor (2) in order to axially guide the anchor (2) on the outer circumference of the guide pin (17).

14. The electromagnetic positioning device according to claim 2, wherein the sliding bearing (21) is fixed on the inner circumference of the yoke section (6).

15. The electromagnetic positioning device according to claim 6, wherein the spring lock washer is made of a material which does not conduct magnetic flow.

16. The electromagnetic positioning device according to claim 15, wherein the material is bronze.

17. The electromagnetic positioning device according to claim 9, wherein the guide opening (13) is a through opening.

18. The electromagnetic positioning device according to claim 9, wherein the push rod section is fixed in the guide opening (13).

* * * * *